US005615522A

United States Patent [19]

Tomanek

[11] Patent Number: 5,615,522

[45] Date of Patent: Apr. 1, 1997

[54] ROOF WINDOW WITH POSITIONING ASSEMBLY

[75] Inventor: Harald Tomanek, Leinfelden-Echterdingen, Germany

[73] Assignee: Roto Frank AG, Leinfelden-Echterdingen, Germany

[21] Appl. No.: 502,274

[22] Filed: Jul. 13, 1995

[30] Foreign Application Priority Data

Jul. 13, 1994 [DE] Germany ..... 9411278 U

[51] Int. Cl.[6] ..... E04B 7/16

[52] U.S. Cl. ..... 52/72; 52/200; 49/394; 292/338

[58] Field of Search ..... 52/72, 200; 49/394; 292/338, 267, 274, 275

[56] References Cited

U.S. PATENT DOCUMENTS

| | | | |
|---|---|---|---|
| 351,147 | 10/1886 | Adams | 292/274 |
| 3,516,210 | 6/1970 | Jentoft et al. | 52/200 X |
| 3,683,450 | 8/1972 | Morrison et al. | 292/275 X |
| 4,845,905 | 7/1989 | Frank | 52/72 |
| 5,450,651 | 9/1995 | Coleman et al. | 292/274 X |

FOREIGN PATENT DOCUMENTS

| | | | |
|---|---|---|---|
| 722450 | 3/1932 | France . | |
| 9406891 | 6/1994 | Germany . | |
| 1456917 | 12/1976 | United Kingdom | 292/338 |
| 8500195 | 1/1985 | WIPO | 52/200 |

*Primary Examiner*—Carl D. Friedman
*Assistant Examiner*—Timothy B. Kang
*Attorney, Agent, or Firm*—Pepe & Hazard

[57] ABSTRACT

A roof window has a locking device (1) for locking the sash (4) in open positions relative to the casing (3); a device for opening the sash including spring arms (2) extending at a right angle to the window casing (3) at least in the closed condition of the roof window, and the spring arms (2) support the window sash (4) on said casing (3) in the open position thereof, the spring arms (2) are operatively connected both to the casing (3) and the window sash (4) by pivot bearings (5, 6), and one of the pivot bearings (6) is disposed on a spring-operated slide (8) movable in a guide (7). The slide being lockable by the locking device (1) which is operatable by a handle (9, 9').

26 Claims, 16 Drawing Sheets

ROOF WINDOW WITH POSITIONING ASSEMBLY

BACKGROUND OF THE INVENTION

The present invention is directed to a roof window with a locking device for locking the sash in open positions relative to the casing, and an opening device provided in the form of at least one spring arm which is disposed at a right angle to the window casing when the roof window is closed, which supports the window sash on the casing in its open position.

Roof windows have to be held in the open position so that they do not return to the closed position or open further because of their weight or under the action of the wind. Until now, rods capable of being hooked or clamped as well as built-in resistance to movement have been proposed as solutions for this problem. However, these solutions developed for window hatches are not satisfactory for use in house roof windows.

Therefore, German Offenlegungschrift 2 422 328 proposes the arrangement of two supporting levers which hold the opened window in its open position by spring force. These supporting levers with springs are mounted on the window sash and move on rollers in guide rails on the window frame, and catch plates hold the window in a desired pivoted position. However, this window is not held securely, particularly in the case of high winds. The holding positions are limited to the catches, and the catches lead to jerky motion when the window is opened and closed.

It is an object of the invention to provide a novel roof window with locking device which guarantees secure holding of the window sash in each open position.

SUMMARY OF THE INVENTION

This object is attained in accordance with the present invention by providing a spring arm which is in operative connection with the casing as well as with the window sash through pivot bearings, and one of the pivot bearings being on a spring-operated slide which is movable in a guide and which can be locked by means of a locking device operated by a handle.

One advantage of the solution in accordance with the invention is the ease of operation. The window is easily openable and closable without being negatively influenced by stiff or jerky operation. On the other hand, the window can be locked securely in any position by the handle. The mechanism is protected against weather influences and is not sensitive to contamination. Only a few parts are visible, so that the appearance of the window is not influenced negatively.

The locking device can be mounted only on one side of the window, in the case of very small roof windows, or it may be located on both sides, which results in greater stability.

Different designs for the location of the slide are possible, and it is possible to provide guides with slides in one or in both side pieces of the frame. However, the guides with slides also can be located on one or in both side pieces of the window sash or they can be mounted via arms which themselves support the window sash. Of course it also is possible for the window sash to be supported by arms, and the spring arms to be hinged to the latter, with the slides being located in guides of the side pieces of the casing.

It is advisable to limit the clamping forces of the locking arrangement so that it is released before the forces acting on the window sash can lead to damage of the sash or frame or operating component.

In one locking device, it is designed as a cam, by which the slide can be locked in the guide by means of the handle.

A further embodiment of the locking device has a wedge with which the slide can be clamped in the guide. In this case it is advisable to introduce an insert between the slide and the wedge so that it is possible to dimension the insert to project over the ends of the guide. The insert is attached on one end of the guide, and on its lower side is locked by the wedge. By means of the longitudinal movement of the wedge, the insert clamps the slide with a predetermined braking force. This design makes it possible for the wedge to lock the slide in a large number of possible positions. This means that the window can be locked in many open positions. In addition, in the case of this design, it is relatively simple to predetermine the locking force.

A further advantageous design consists in having the wedge made so that it can move on a inclined plane, with the wedge having a length which corresponds to at least the length of the guide, and the slope of the inclined plane and the opposite slope of the wedge have the same angle of inclination, so that the wedge surface serving as a clamping surface is vertically adjustable by means of longitudinal displacement of the wedge. An absolutely parallel adjustment of the clamping surface at any length can be obtained by the interaction of wedge and inclined plane, and the clamping force, independently of the position of the slide is precisely adjustable at the same time.

In all embodiments, the clamping forces can be increased by having the guide bear a plastic layer at least on one side.

A further design of the locking device is one which the slide bears a toothed rack into which a holding element with at least one tooth can be engaged and disengaged. In this case, the holding element can be mounted on a connecting rod. If the guide is located in a tube and the connecting rod extends along the outside surface, the tube has an aperture which the holding element can enter and reemerge upon operation of the connecting rod in order to be able to engage with, and release, the toothed rack. If the connecting rod is a spring-mounted connecting rod, it is possible to push it in the direction of the engagement position by means of a holder. In the case of this configuration, there is a tapered surface on the holding element to facilitate its exiting the aperture, and this tapered surface advantageously cooperates with a tapered surface on the tube bounding the aperture and this taper advantageously works together with the chamfer of the recess. In this embodiment, the slide can be locked on the entire length of the toothed rack, thus providing a locking capability over a great range of adjustment of the window. It is also possible to limit the clamping forces by having the tooth surfaces have a relatively flat angle.

An especially high degree of operating ease is achieved by the fact that a handle can operate at least one locking device as well as perform the closing and opening of the window sash. A favorable arrangement consists in the fact that the handle is located on the lower cross-piece of the window sash. The force transfer then takes place through corner guides and connecting rods which operate the closing pieces and which are in operative connection with at least one locking device. In order to make it easy to operate the window, it is advisable for the locking device to lock the window sash in such a way that, when the window sash is open, the handle is brought into its closing position from its pivoted position.

The following developments are advantageous for a roof window embodiment which can perform swinging motions in addition to tilting motion, in the case of which the window can be pivoted around the suspension on two open arms. For this purpose, two spring arms are mounted on arms suspended and swivelling on the upper end of the casing, and the window sash is held for turning by the arms and optionally in connection with them. The arms can be locked through the spring arms by means of the locking device. In this case, the window sash can be guided by two axial pins in seated grooves of the casing at the same time in order to obtain sure guiding and holding of the window sash.

One embodiment provides for making the roof window in such a way that the lock cannot be engaged in this swinging position but only in the tilting position. Such a development results from the fact that, in the tilted-open positions of the window sash, the latter is significantly more sensitive to the forces acting on it than in the swinging position, in which the pivot pins in the grooves lend an additional stability to the window sash and a locking device is no longer required in every case. In a roof window which is suspended and capable of turning on arms and can be brought by choice into either a tilted-open position or a swinging position, the operative connection has to be made between the handle and the locking devices or the locking device. A coupling between the handle and the locking device, which is connected in the swinging position, is provided in order to operate a locking device located on or in an arm. The coupling is made as a transfer element which has a U-shaped indentation into which a pin connected with the connecting rod then engages when the window sash is connected with the arms. If the window sash is brought into the swinging position, the pin moves out of the U-shaped indentation of the transfer element and the operative connection is uncoupled.

In an embodiment in which a window sash is guided in the grooves of the window casing in the swinging position by means of two pivot pins, the above-mentioned pins can be identical with the pivot pins. The arrangement of the pivot pins and the grooves then is such that, in the tilted position, the pivot pins are located on an arc of a circle which passes above an upper opening of the grooves. By adjusting the pivot pins, in the swinging position the latter enter the grooves. In the case of opening the window in this position, the operative connection, as described above, is uncoupled. When the window sash is closed and when it is in the tilted position, it is connected with the arms and the operative connection is made between handle and locking device.

The following further development is proposed in the case of this embodiment in order to guarantee that the pivot pins always engage in the U-shaped indentations of the transfer element when the window sash out of the swinging position into the tilting position; and a catch, by means of which the handle is blocked when a window sash is open in the swinging position, acts on the handle. If the window sash is closed, this blocking is released and only in the closed position of the window sash can the handle be brought from its swinging position into the tilting position or the locking position.

BRIEF DESCRIPTION OF THE DRAWINGS

The invention is explained below by means of specific embodiments shown in the drawings wherein.

DETAILED DESCRIPTION OF THE ILLUSTRATED EMBODIMENTS

Figure 1:
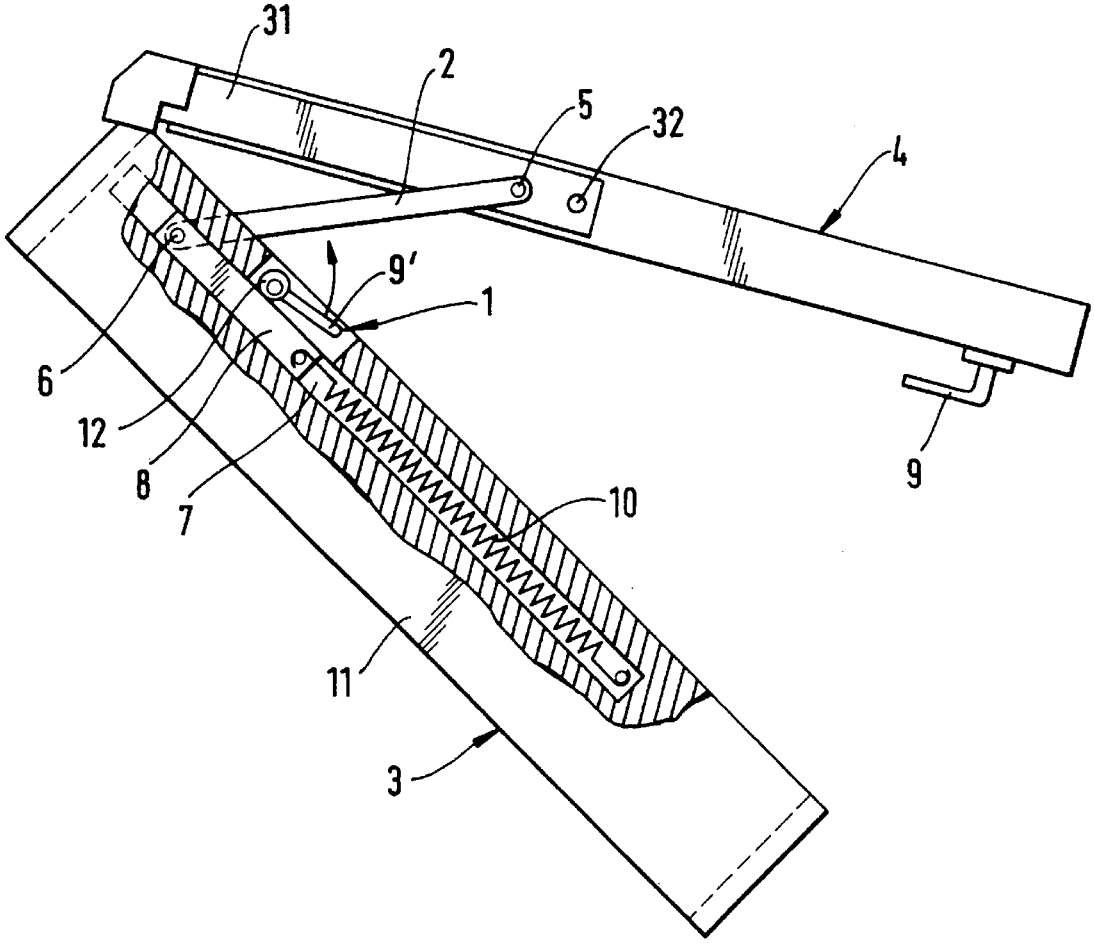
FIG. 1 shows the principle of the invention using the example of a first specific embodiment of the locking device of the present invention.

FIG. 1 shows a roof window embodying in a side view, partially in section. The principles of the present invention are explained by means of this first, simple specific embodiment of a locking device.

The roof window consists of a casing 3, which is installed in a roof surface (not shown), and to the upper end of which a window sash 4 is hinged. This hinging can be made directly or by arms 31, the front ends of which have a bearing 32 coupled to the window sash 4. In the last-mentioned case, in addition to the tilting motion, the window sash 4 can perform a swivelling around the bearing 32; this is the swinging position of the roof window. If such arms 31 are provided, the window sash 4 is firmly connected with the arms 31 in the tilting position shown. An opening device in the form of one or two spring arms 2 acts upon the window sash 4 with a force in the direction of opening. For this purpose, the spring arm 2 has pivot bearings 5 and 6 on its ends, with the pivot bearing 5 being located on the window sash 4 or on the arm 31 and the other pivot bearing 6 lying on a slide 8. The spring arm 2 can perform a swivelling motion on both pivot bearings 5 and 6. The slide 8 is able in a guide 7 and is acted upon by a spring 10 with a force which is transferred to the window sash 4 as an opening force. The guide 7 with the slide 8 and the spring 10 are housed in the side frame member 11 of the window casing 3. Preferably spring arms 2 of this type with these components are present on both sides of the window sash 4. At least one of the slides 8 can be locked in its guide 7 by means of a locking device 1 by operating the handle 9. In the specific embodiment of FIG. 1, the locking device 1 is made in the form of a cam 12, which is mounted in the side frame member 11 of the window casing 3 and clamps the slide 8 in the guide 7 when the handle 9' moves in the direction of the arrow.

In contrast to the design shown in FIG. 1, the spring arm 2 also can be arranged so that the slide 8 with the spring 10 is housed in the window sash 4, and a simple pivot bearing of the spring arm 2 is located on the window casing 3. It is essential that the spring arm 2 pass at an acute angle to the casing 3, at least when the window is closed, so that, by moving the slide 8 to change its angular position, it is possible to act upon the window sash 4 with a force in the direction of opening. Only when the window sash 4 is completely open can the angle of the spring arm 2 to the casing 3 also approach a right angle.

It is advisable to limit the clamping force of the locking device 1 so that the locking device 1 is released and releases the slide 8 before the forces acting on the window sash 4 can create damage. This is true both for the locking device 1 described above as well as for further possible embodiments of the locking device 1.

Figures 2, 2A:
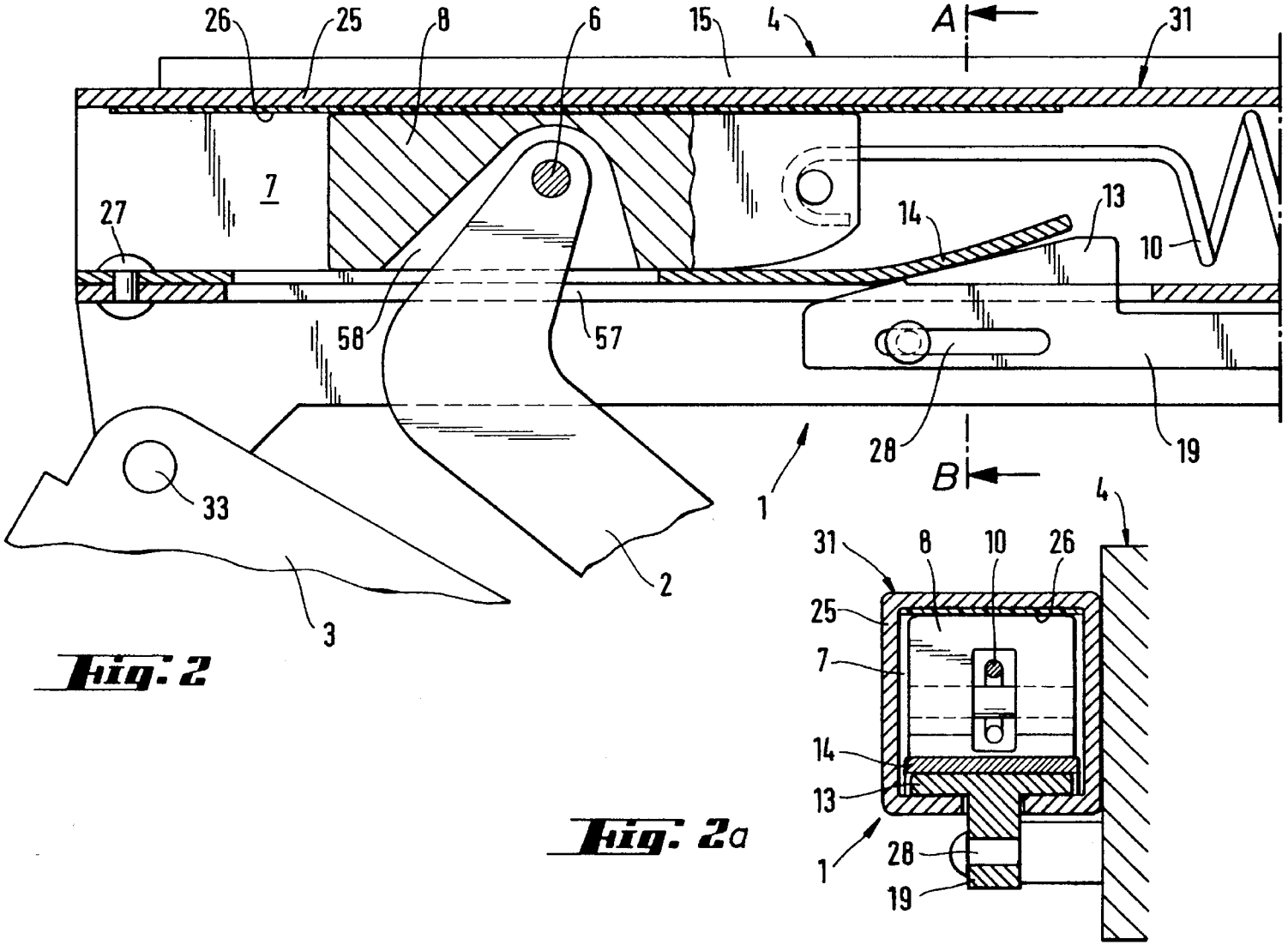
FIGS. 2 and 2*a* show a partial view of a roof window with a second embodiment of the locking device.

FIGS. 2 and 2*a* show a partial view of a roof window with a second embodiment of the locking device 1. FIG. 2 is a sectional view along an arm 31 and FIG. 2*a* is a view of the section A-B shown in FIG. 2. In this embodiment of the locking device 1, the slide 8 can be clamped in the guide 7 by means of a wedge 13. The guide 7 is located in a tube 25, and this may be an essential component of the arm 31. The spring arm 2 engages in the tube 25 by means of a slot 57 and is connected with the slide 8 by means of a pivot bearing 6. The pivot bearing 6 is located in a recess 58 in the slide 8, into which the spring arm 2 engages. A spring 10, which acts upon the slide 8 with the force supporting the opening of the window sash 4, is suspended on the slide 8. In order to clamp the side 8 in the guide 7 with a relatively wide range of adjustment, there is an insert 14 which projects beyond both ends of the guide 7 and is connected on one end with the tube 25 by means of a fastener 27. On the opposite end the insert 14 is locked by the wedge 13. The wedge 14 has a slot through which the arm 2 extends. Depending on the position which the wedge 14 assumes, the slide 8 is pushed against the wall of the tube 25 by the insert 14 with a force which secures the slide 8 in position. The locking is performed in this way. The wall of the tube 25 can be provided with a plastic layer 26 in order to obtain higher holding forces.

FIG. 2*a* is a section along the line A-B, which is indicated in FIG. 2. From these figures it can be seen how the wedge 13 is located in the tube 25 and how it pushes the insert 14 against the slide 4 in the case of movement to the left in such a way that the latter is fixed in position on the wall of the tube 25. In the case of movement to the right this force acting upon the insert 14 is reduced or eliminated. A connecting rod 19, which is in operative connection with the handle 9 and connected with the wedge 13 through a slot in the tube 25, serves to move the wedge 13.

The embodiment shown in FIGS. 2 and 2*a* has the advantage that a predetermined clamping force can be exerted on the slide 8 in a wide range of its possible positions and thus the window sash 4 can be secured in place in different open positions.

Figure 2B:
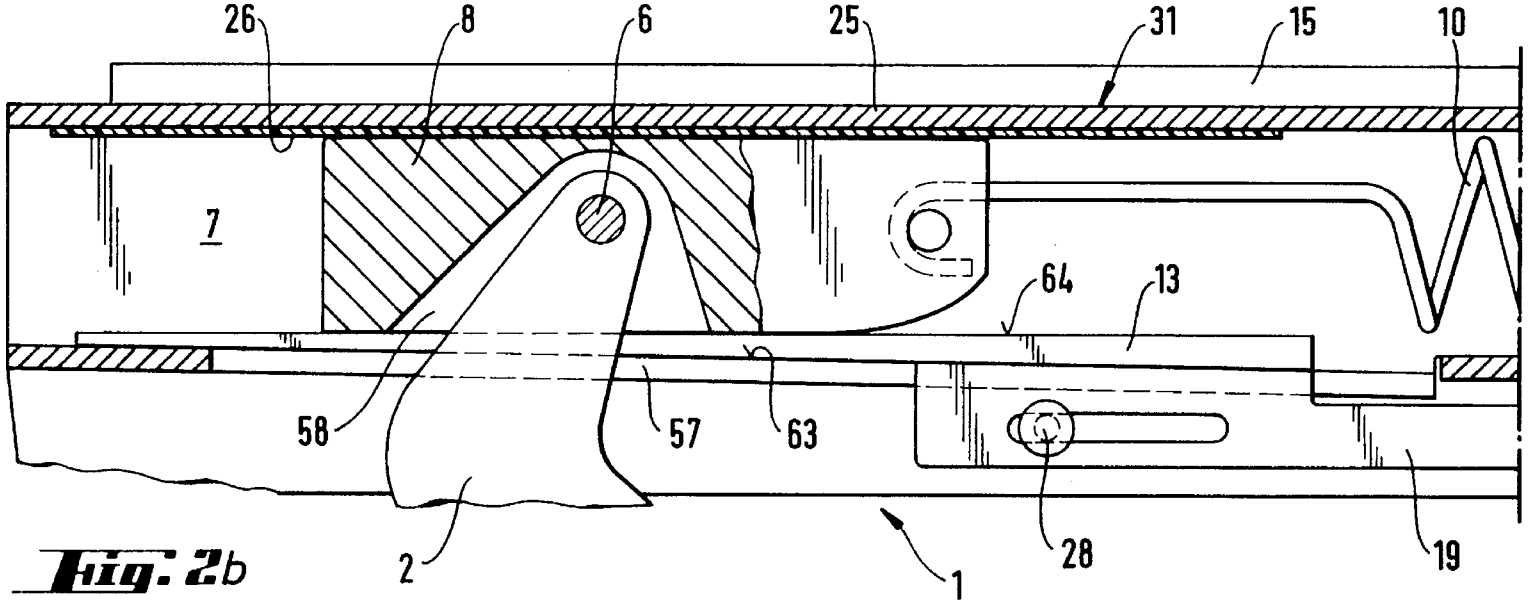
FIG. 2*b* shows a section of a corresponding partial view of a third embodiment of a locking device.

FIG. 2*b* shows a third locking position and is a section which corresponds to the lower part of the section of FIG. 2. The third locking device differs from the second only in this area. This wedge 13 is made in a length which corresponds at least to the length of the guide 7, and is mounted on a inclined plane 63 so that slopes upwardly to the clamping surface 64. Therefore, the sloping surfaces extend oppositely to each other at the same angle. The clamping surface 64 is vertically adjustable by means of longitudinal movement of the wedge 13. In this way, with a predetermined longitudinal movement of the wedge 13, the slide 8 can be secured in place in the area of the entire guide 7 with a specific clamping force which is independent of the position of the slide 8 in the guide 7.

Figure 3:
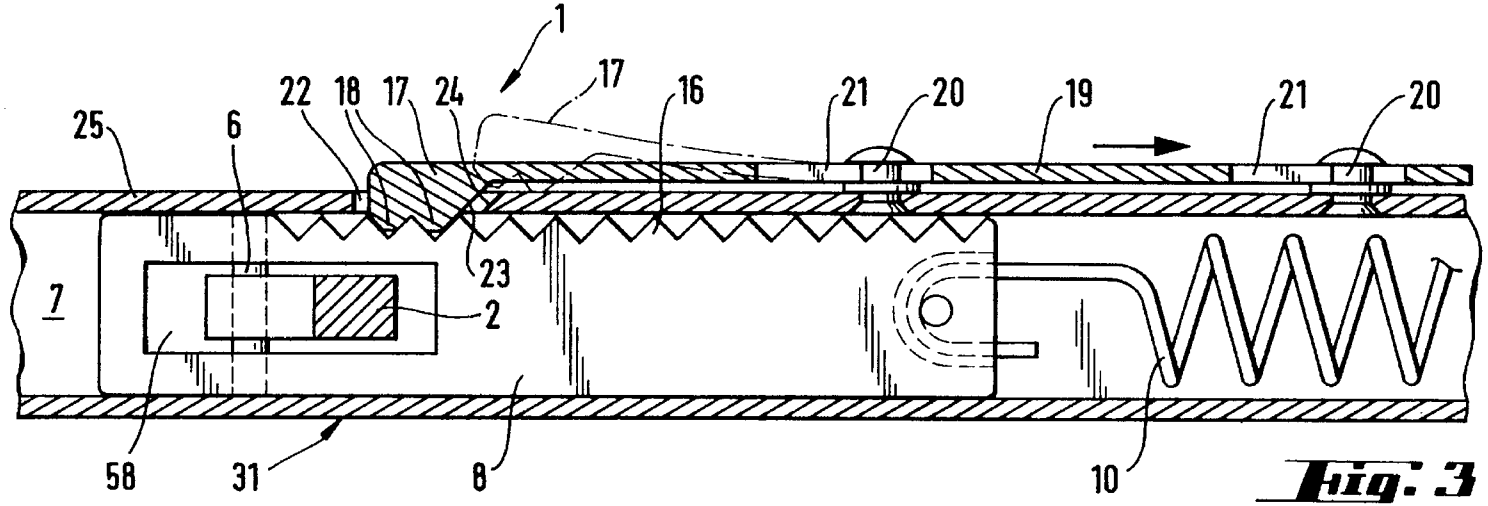
FIG. 3 shows a fourth embodiment of a locking device.

FIG. 3 shows a fourth specific embodiment of a locking device. The slide 8 bears a toothed rack 16 with which a holding element 17 having teeth 18 can be brought into and out of engagement. The holding element 17 is connected to a connecting rod 19 which can be operated via the handle 9. In order to engage and disengage the holding element 17, the tube 25 is equipped with a recess 22 into which the holding element 17 engages in one position and from which it slides outwardly into a second position. The second position is shown with a dash-dot line. In order to achieve this mode of operation, at least the part of the connecting rod 19 adjacent the holding element 17 is spring-mounted and held by means of a fastener 20 which, for example, can be a rivet or a bolt guided in a slot 21 in the connecting rod 19. In order to make it possible to slide the holding element 17 outwardly of the recess 22, the holding element 17 is provided with a tapered surface 23 and the recess 22 has a chamfered surface 24 acting together with the surface 23. The toothed rack 16 and the teeth 18 of the holding element 17 can be made flat so that the holding element 17 is pushed to the outside by the action of a specific force and then enables the slide 8 to move. The remaining components correspond to these described for FIG. 2, the spring arm 2 having a sectioned surface since the locking device 1 of FIG. 3 is shown from below. A recess 58 in the slide 8, in which the spring arm 2 engages, also is visible from below in this view.

Figure 4:
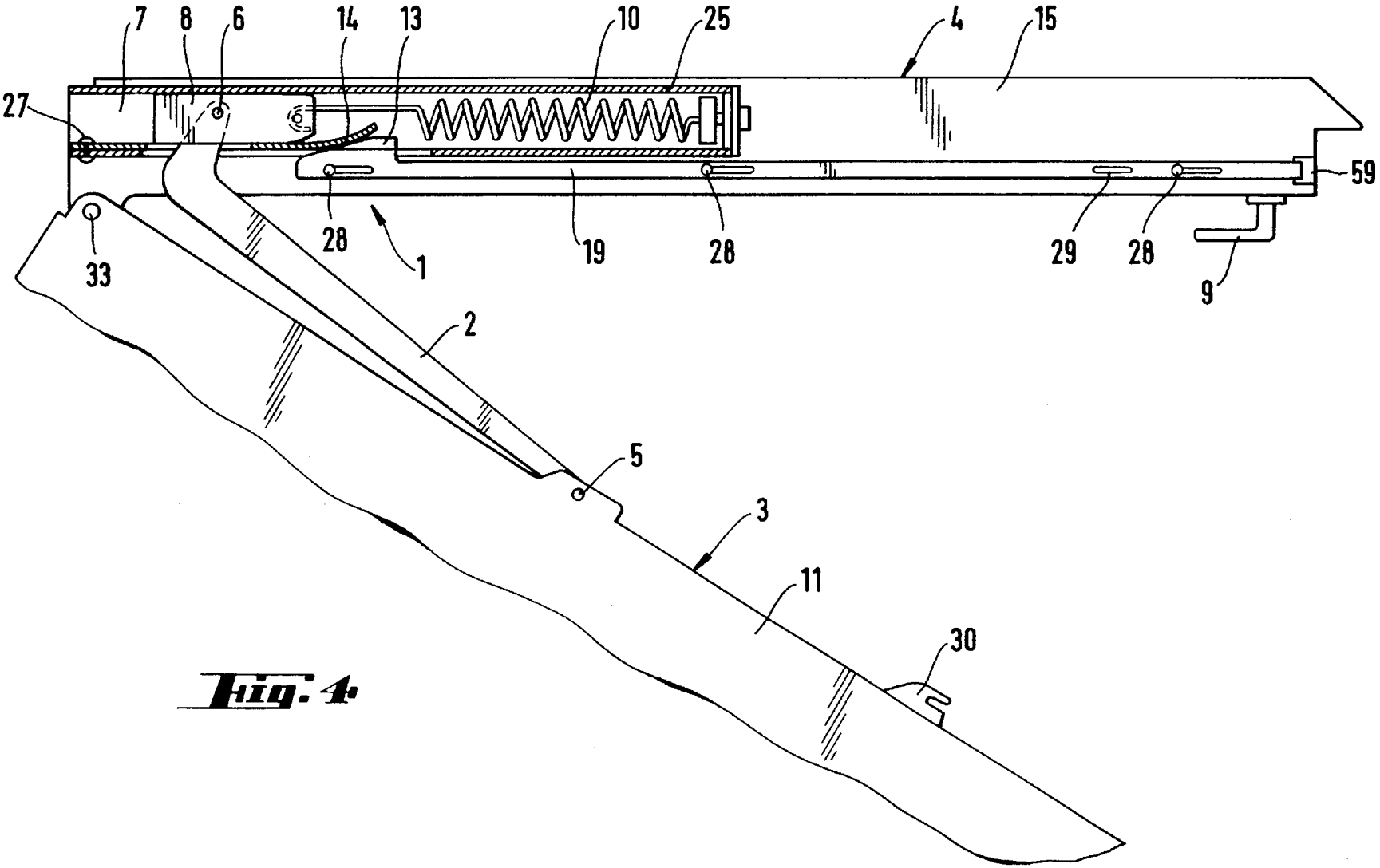
FIG. 4 shows an operative connection between the locking device and further functional elements of the window.

FIG. 4 shows a roof window in which an operative connection of locking device 1 with further functional elements of the window is shown. The window sash 4 is hinged to the casing by means of a pivot suspension 33. The spring arm 2 (as a rule spring arms 2 are located on both sides) are mounted in the reverse direction as compared with FIG. 1. They are hinged to the casing 3 by pivot bearings 5, expand upwardly at an acute angle with the latter, and are hinged on slides 8 by pivot bearings 6. The slides 8 are movable in guides 7 which are located in side frame elements 15 of the window sash 4. Forces which push the window sash 4 into the open direction act upon the slides 8 by means of springs 10. The locking devices 1 correspond to those described in FIGS. 2 and 2*a*.

Connecting rods 19, which are guided by the connecting rod guides 28, pass along the side frame element 15 of the window sash 4. Adjacent the outer end in the front area of the connecting rods 19, there are closing tongues 29 which engage closing elements 30 on the window casing 3 in order to close the window. On the front end of the side frame elements 15, there are corner guides 59, not shown in greater detail, which ensure the connection of the connecting rods 19 to the handle 9. On the handle 9 there is an expanding mechanism which makes sure that the parts described are operated synchronously on both side frame elements. If the window is to be opened, then the closing tongues 29 emerge from the closing elements 30 by adjusting the handle into its opening position, and, at the same time, the wedges 13 release the slides 8 and the latter can move in the guides 7.

For locking with the window open, the handle 9 is moved into the locking position again, in which the wedges 13 push the inserts 14 upwardly and secure the slide 8 in position within the guides 7. In this way, the window sash 4 is locked securely in the desired position. Of course this configuration also is possible with other embodiments of the locking device 1.

Figure 5:
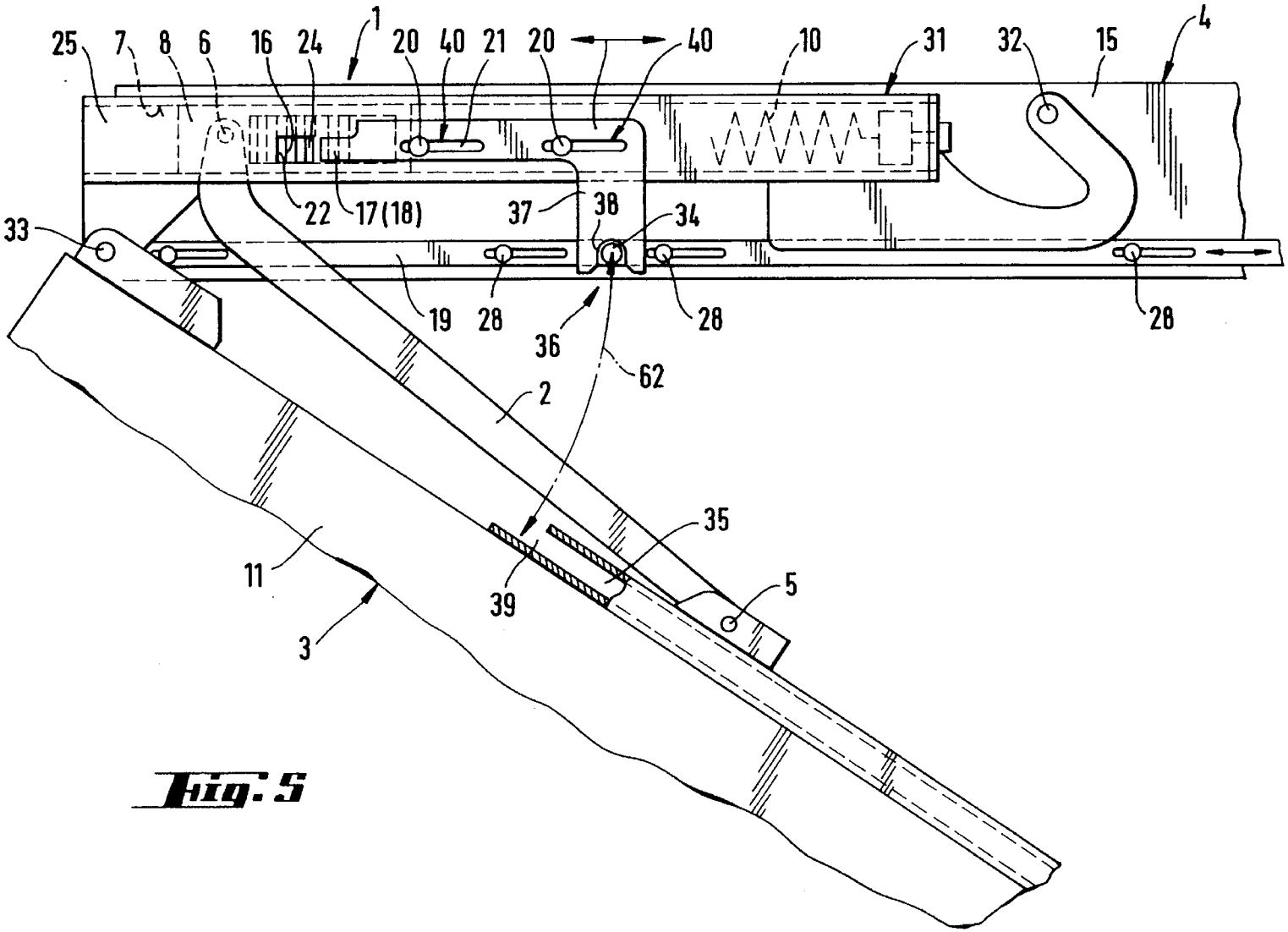
FIGS. 5 and 6 show further possible operative connections.
Figure 6:
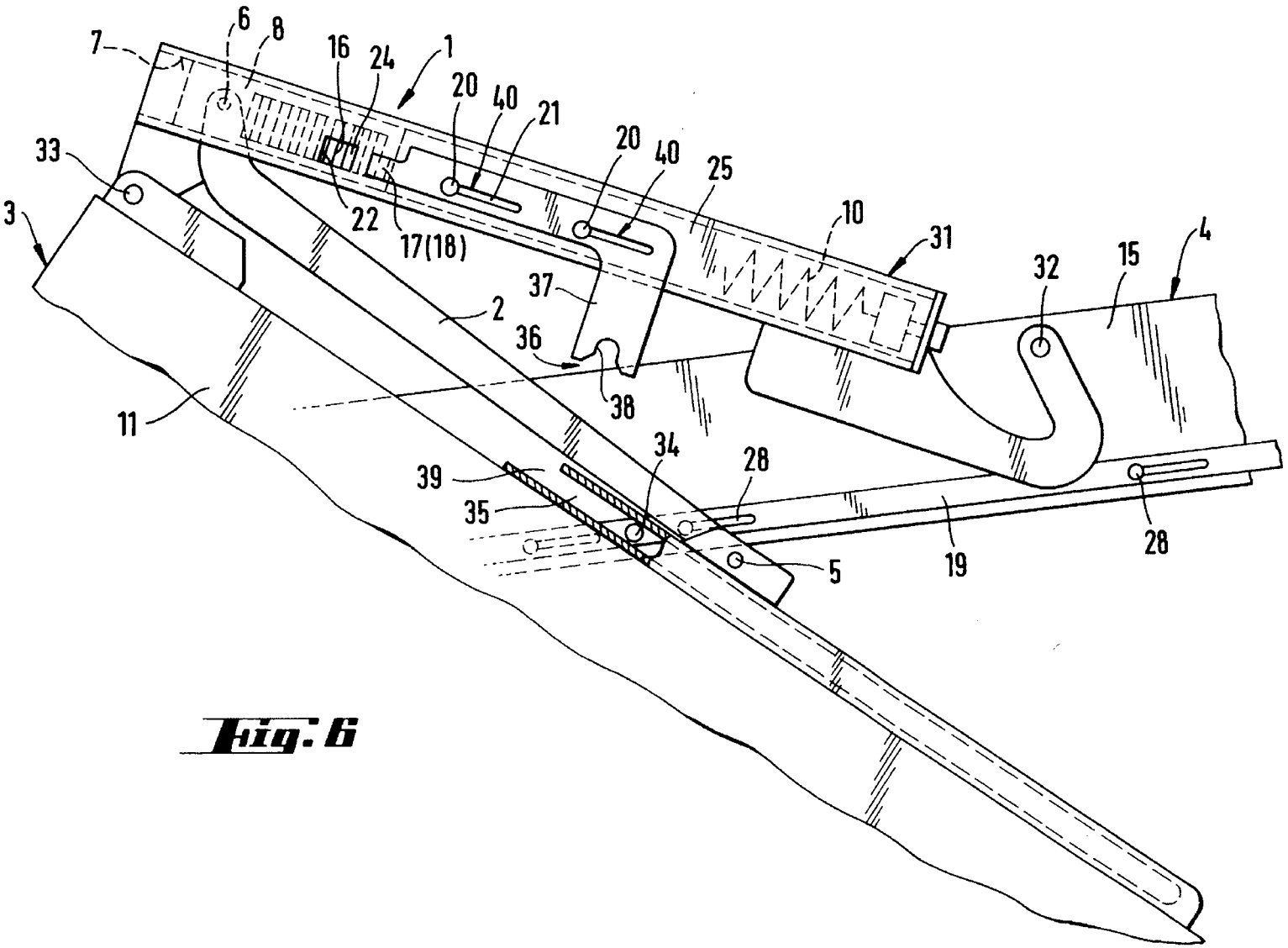
Figure 11:
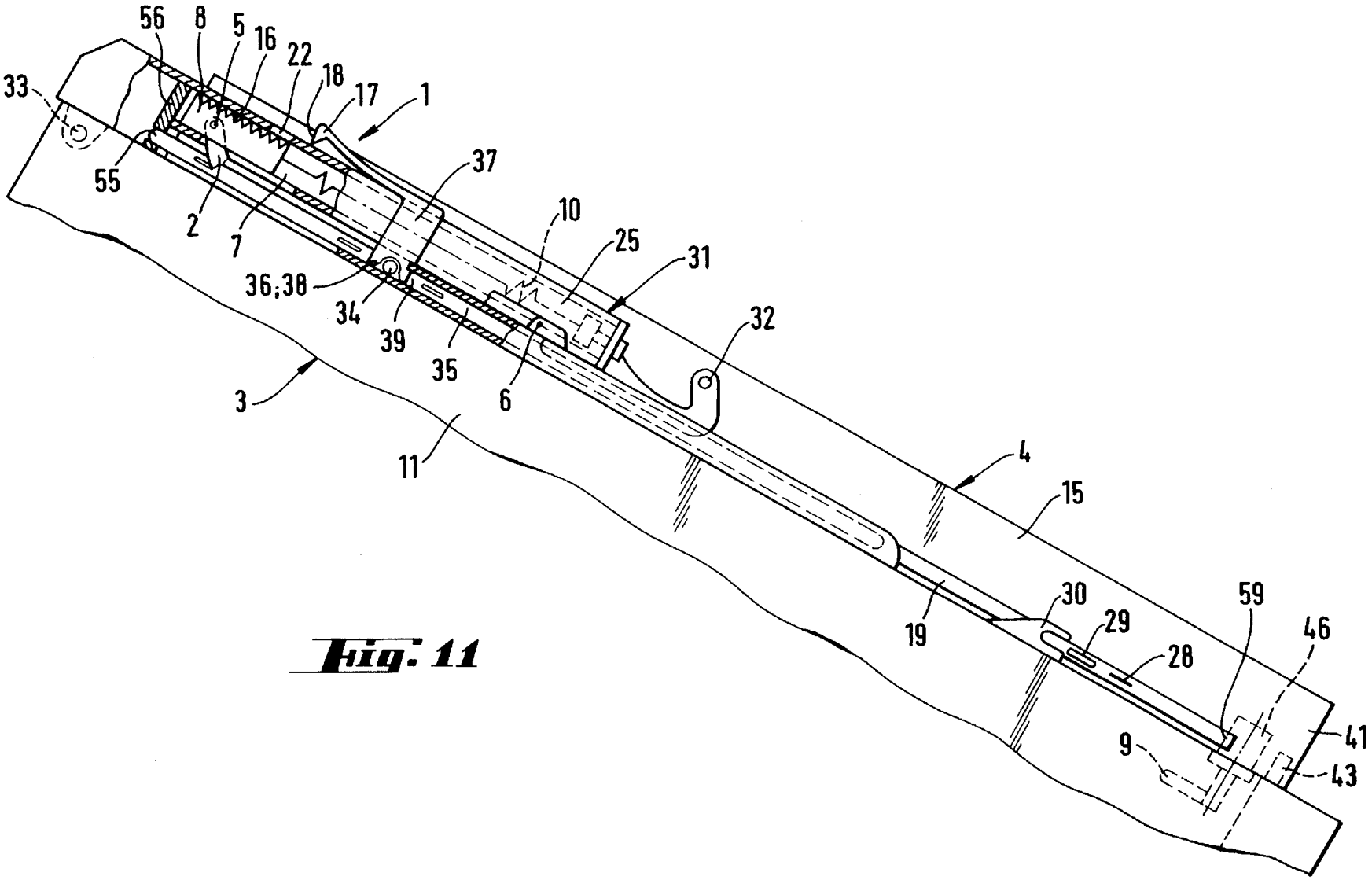

FIGS. 5 and 6 show another operative connection of a locking device 1 with functional elements of a window, which can be opened both in the tilted position as well as in the swinging position. As opposed to the window illustrated in FIG. 4, the window can be brought into the swinging position and has two pivot pins 34 which are located on the side frame elements 15 of the window sash 4. In the swinging position, these pivot pins 24 enter grooves 35 which are located on the window casing 3 and which have openings 39 at their upper end. In order to obtain the swivelling motion required for this, it is further necessary that the window sash 4 be suspended on arms 31 hinged on the window casing 3. The bearings 32 on the front ends of the arms 31 serve this purpose. In addition, there are two locking bars 55 (see FIGS. 11, 14, and 16) which connect the window sash 4 firmly with the arms 31 when the window is to be opened in the tilted position. Preferably, such locking bars 55 are located on the upper end of the window and also can be engaged and disengaged by the connecting rods 19 which are operated by the handle 9.

In the window shown, the pivot pins 34 are arranged so that in the case of the closed window position, when the handle 9 is brought into the tilting position, the pins 34 lie above the upper openings 39 of the grooves 35. In order to be able to bring the window into the swinging position, the pivot pins 34 are brought into a position in which they enter the upper openings 39 of the grooves 35 by operation of the handle 9. For this purpose, the pivot pins 34 are connected to the connecting rods 19.

In the specific embodiment described, the pivot pins 34 serve to simultaneously operate the locking device 1. The locking device in FIG. 3 is shown as an example of a locking device of this kind; however, a locking device corresponding to those in FIG. 2 or FIG. *2b*, or another design, can be used. When the window is closed or in the tilted position which is shown in FIG. 5, the pivot pins 34 engage in U-shaped indentations 38 of transfer elements 37. The transfer elements 37 are mounted so that they are movable in guides 40 on the outside of the tubes 25. The tubes 25 essentially form the arms 31 which bear the window sash 4.

The embodiment shown in FIGS. 5 and 6 has the following functions. If the handle 9 is in the closing position when the window is closed, the closing tongues 29 engage in the closing elements 30 as was already explained with respect to FIG. 4. (The corresponding parts are not shown in FIGS. 5 and 6). If the window sash 4 is to be moved into the tilted position shown in FIG. 5, by adjusting the handle 9 into its tilting position (seen in FIG. 10), the closing tongues 29 move out of the closing elements 30 and the window sash 4 can be tilted since it is connected with the arms 31 by the locking bars 55. If, in the tilted position shown in FIG. 5, the handle 9 moves into the closing position (FIG. 13), the pivot pins 34 transfer this motion by the transfer elements 37 to the locking devices 1, which secure the slides 8 in position in the way already described for FIGS. 3 and 4, and in this way secure the window sash 4.

In order to bring the window sash 4 into the swinging position, it has to be closed and the handle 9 has to be moved into the swinging position (FIG. 9), which causes the pivot pins 24 to enter the upper openings 39 of the grooves 35. At the same time the locking bars 55 release the connection between the window sash 4 and the arms 31, and the window sash 4 can be swivelled around the bearings 32. Now, if the window sash 4 is opened, it swivels around the bearing 32 and at the same time the pivot pins 34 slide downwardly in the grooves 35. At the beginning of this movement, the pivot pins 34 emerge from the U-shaped indentations 38 of the transfer elements 37 (seen in FIGS. 6 and 8). Therefore the locking device 1 no longer can be operated in the swinging position by means of the handle 9. In order to ensure that the pivot pins 34 enter the U-shaped indentations 38 of the transfer elements 37 at the time of closing the window, it is advisable to install a catch 43 which acts on the handle 9 in so that the latter no longer can be operated if a window is opened in the swinging position.

FIGS. 7, 9, 10, 12, 13, and 15 show the catch 43 for preventing operating errors in different functional positions of the handle 9 as well as in different positions of the window sash 4. The positions of the functional elements of the roof window shown correspond to these handle positions. These are diagrammatic sketches.

Figure 7:
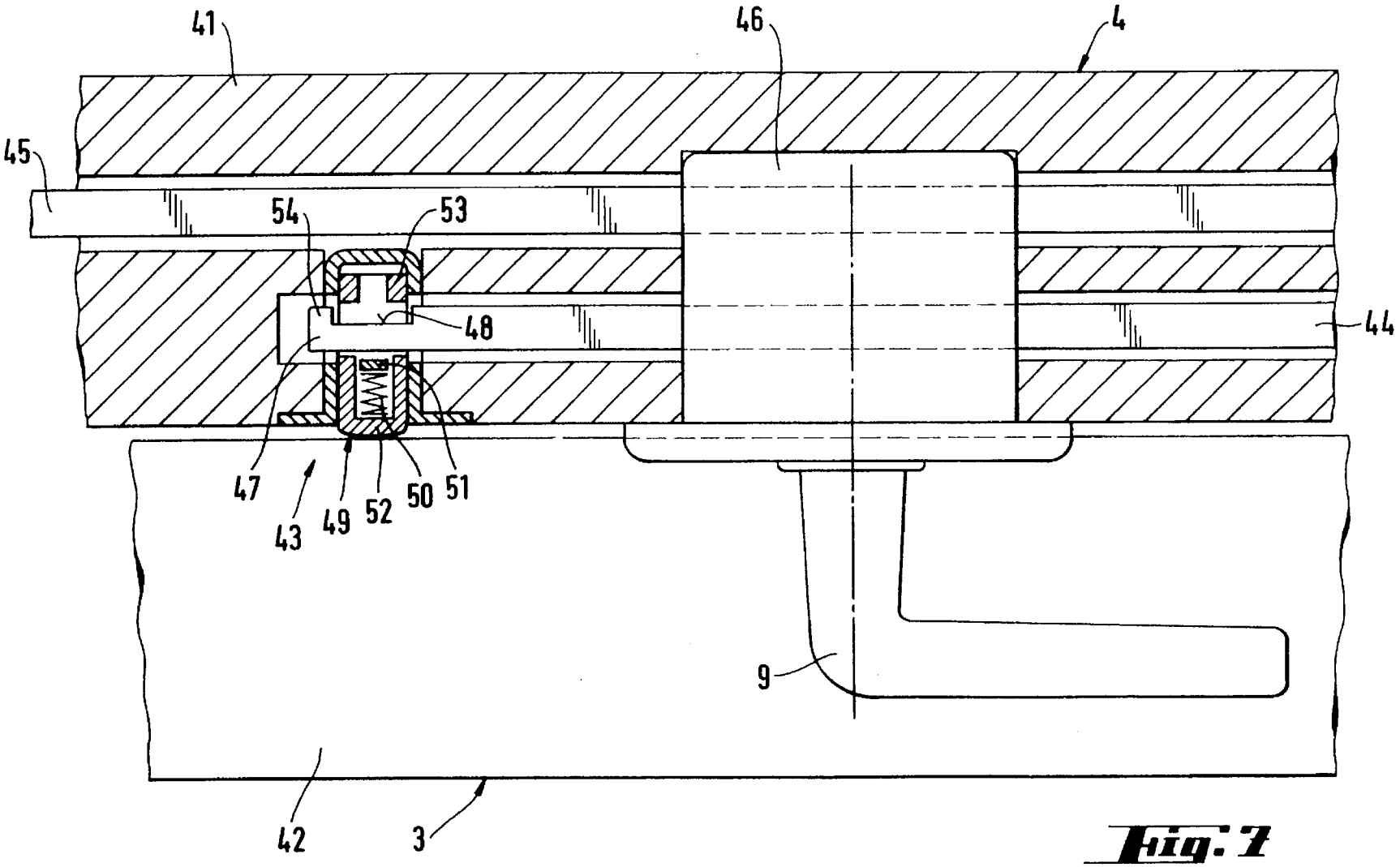
FIGS. 7, 9, 10, 12, 13 and 15 show a catch in different functional positions of the handle for preventing operating errors.

FIG. 7 shows a section of the frame lower cross-piece 41 of the window sash 4 as well as the opposite section from the frame lower cross-piece 42 of the window casing 3. The handle 9 with an expanding mechanism 46 is located in the frame lower cross-piece 41 of the window sash 4. The expanding mechanism 46 can be a toothed wheel which engages in toothed racks of the connecting rods 44 and 45. These connecting rods 44 and 45 extend to the front corners of the window sash 4 and there are connected with corner guides 59, which further transfer the adjusting motions to the connecting rods 19 on both sides of the window sash 4. One of the connecting rods 44 has one end 47 which projects beyond the expanding mechanism 46 and there forms a hook 54 by means of a slot 48 in which a notch 53 engages depending on the position of the catch 43. In the case of the illustration of FIG. 7, the window sash 4 is closed, by which the frame lower cross-piece 41 of the window sash 4 lies on the frame lower cross-piece 42 of the window casing 3. In this position, the catch 43 is disengaged since the frame lower cross-piece 42 pushes a bend 52 of the blocking element 49 upwardly against the force of a spring 50. The spring 50 is supported on a holding lug 51, which is located on the frame lower cross-piece 41 of the window sash 4. The position illustrated corresponds to a closed position of the window sash 4, with the handle 9 being located in the position in which the window sash 4 is moved in the case of opening into the swinging position, which is shown in FIG. 6.

Figure 8:
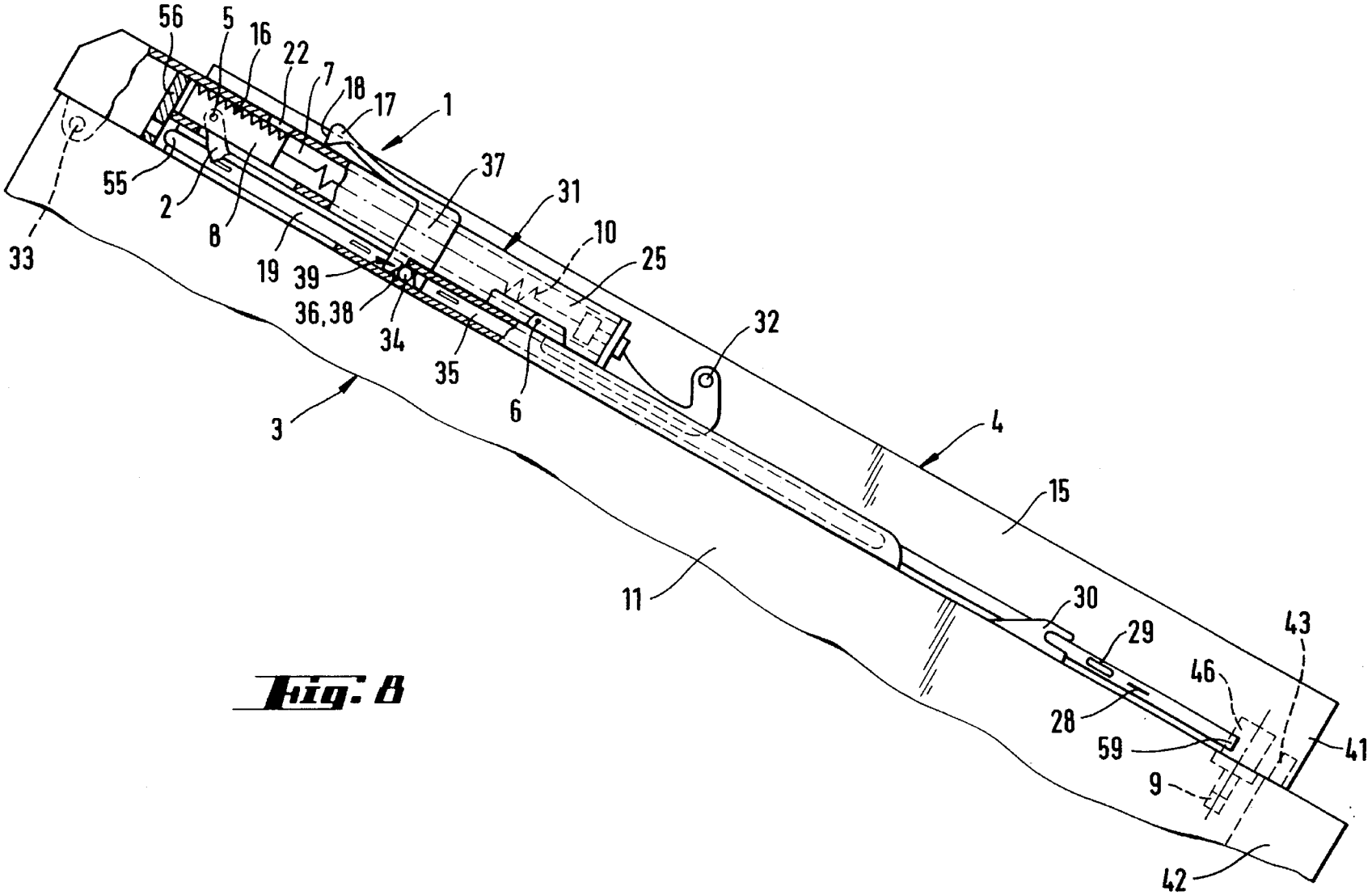
FIGS. 8, 11, 14 and 16 show diagrammatic sketches of a roof window with functional elements, the positions of which are associated with the functional positions of the handle in the above-mentioned figures.
Figure 9:
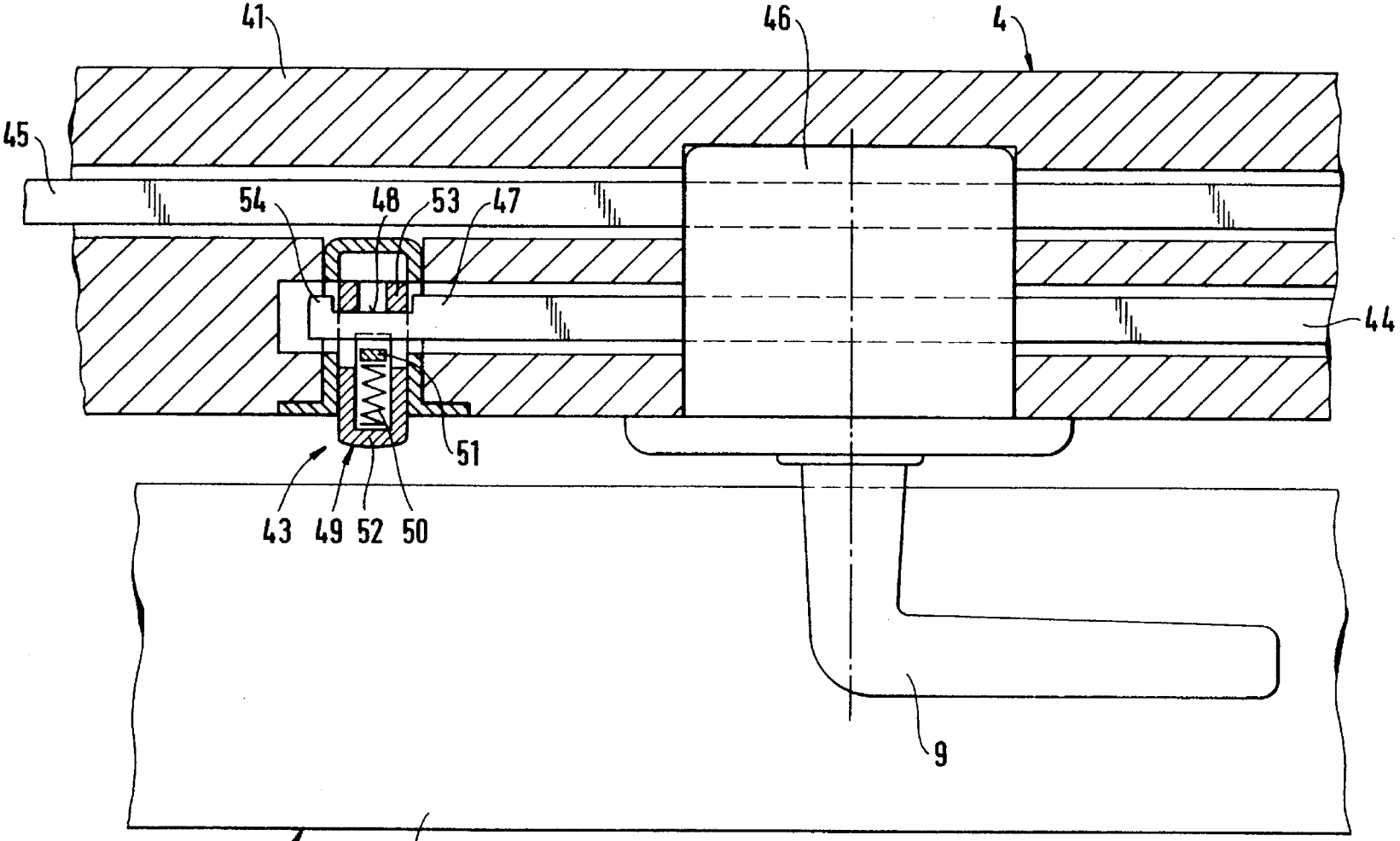

FIG. 8 is a schematic diagram of the window in side elevation, and the position of the handle 9 and the window sash 4 correspond to FIG. 7. In this position, the closing tongues 29 connected with the connecting rods 19 are not engaged with the closing elements 30, and the window sash 4 can be opened. By setting the handle 9 into the swinging position shown in FIG. 7, the locking bars 55 are removed from the closing plates 56 and the pivot pins 34 on both sides of the window sash 4 enter into the upper openings 39 of the grooves 35. In the closed position of the window, the pivot pins 34 are still in the U-shaped indentations 38 of the transfer elements. The holding element 17 is shown symbolically with one tooth 18 in order to show that it is remote from the toothed rack 16 and therefore the slide is not secured in position. If the window is opened in this position, as is shown in FIG. 6, the pivot pins 34 emerge from the U-shaped indentations 38, and are therefore out of engagement, and they can no longer be pushed by adjusting the handle 9 since they no longer engage into the U-shaped indentations 38 of the transfer elements 37 when reclosing the window sash 4. An operating error of this type would make the locking device no longer serviceable. For this reason, the catch 43 thus blocks the handle 9 at the time of opening the window sash 4, as is shown in FIG. 9. This takes place because the spring 50 pushes the blocking element 49 downwardly as a result of opening the window, and the catch 53 engages in the notch 48 and thus secures the connecting rod 44. The other connecting rod blocked by the expanding mechanism 46.

Figure 10:
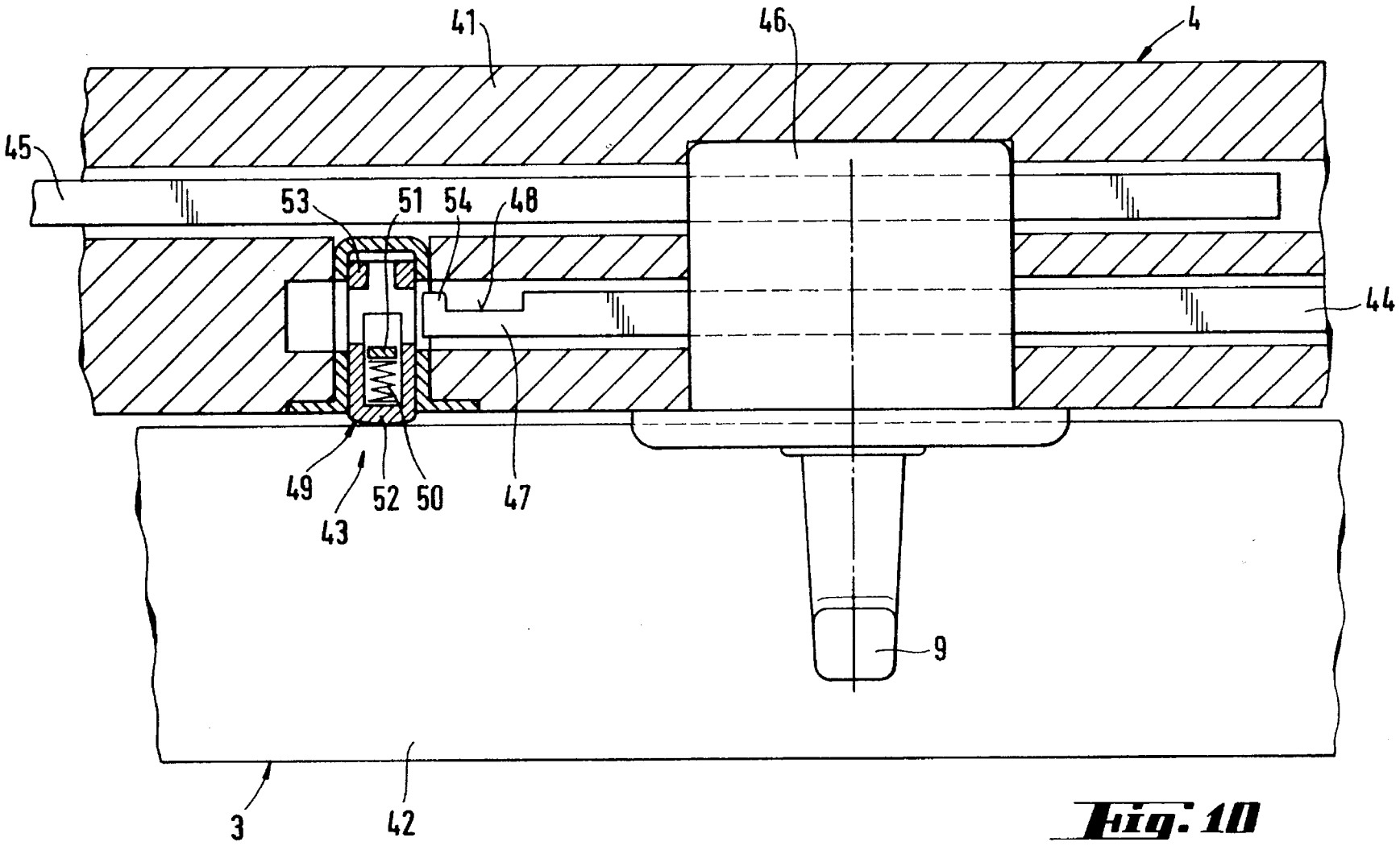

FIG. 10 shows the handle 9 in the position in which the window sash 4 assumes a tilted position when opened. The end of the connecting rod 47 projecting over the expanding mechanism 46 is located in a position in which the hook 54 can no longer be held by the catch 43 when the window sash 4 is opened. The illustration in side view of the window in FIG. 11, in which the closing tongues 29 are disengaged from the closing elements 30, corresponds to this position.

The pivot pins 34 are outside of the grooves 35 and the locking bars 55 are inserted into the locking plates 56 by which the window sash 4 is connected to the arms 31. The pivot pins 34 are located in the U-shaped indentations 38 of the transfer element 37, and the holding elements 17 assume a position in which they are disengaged with respect to the toothed racks 16. Thus, the slides 8 are freely movable, which is necessary for the opening of the window sash 4. The opening motion is supported by having the springs 10 act upon the slides 8 with force and thus the spring arms push the window sash 4 upwardly. If the window sash opens from this position of the functional elements shown in FIG. 11, the situation shown in FIG. 12 takes place in the area of the catch 43.

Figure 12:
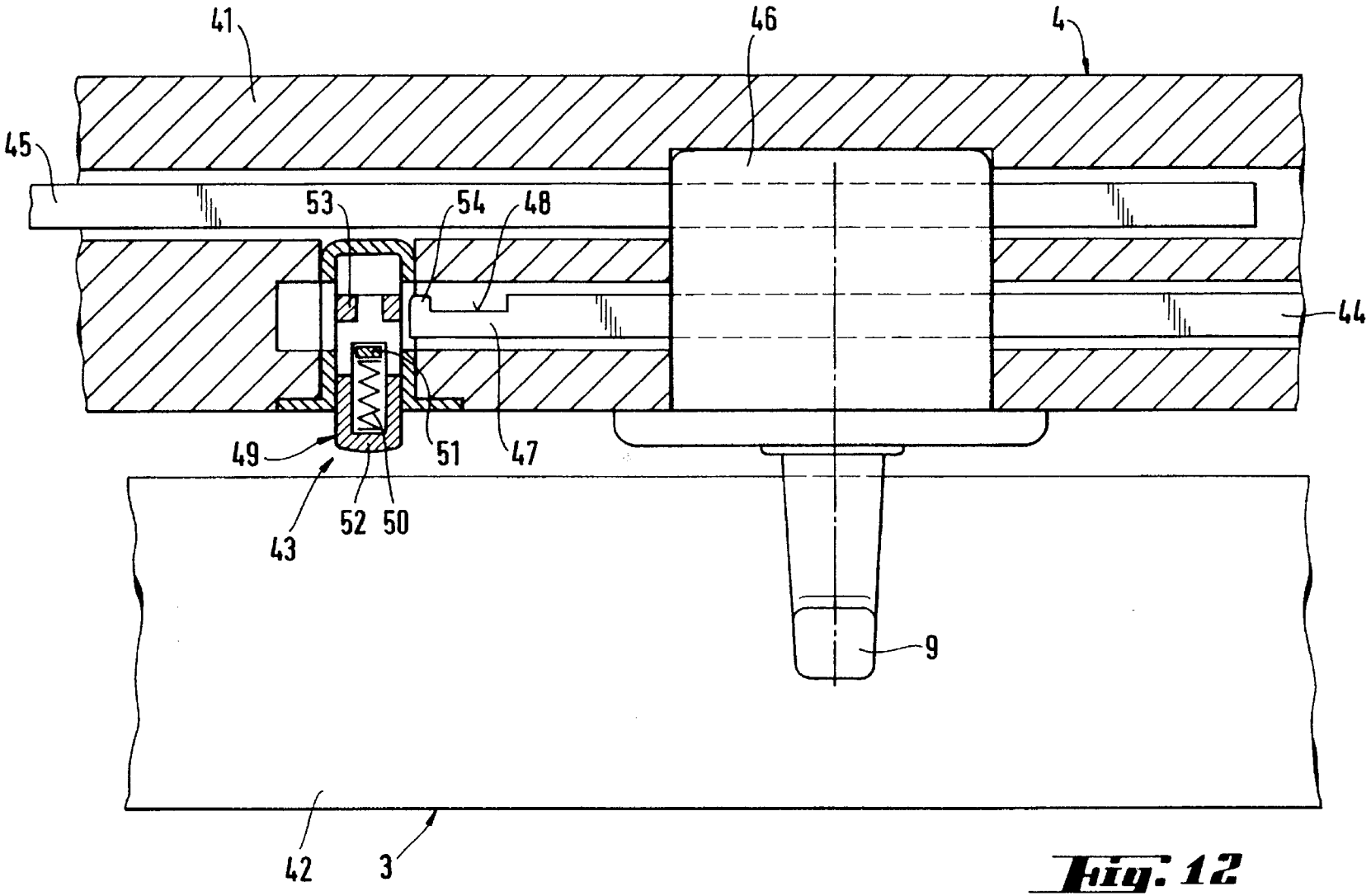
Figure 13:
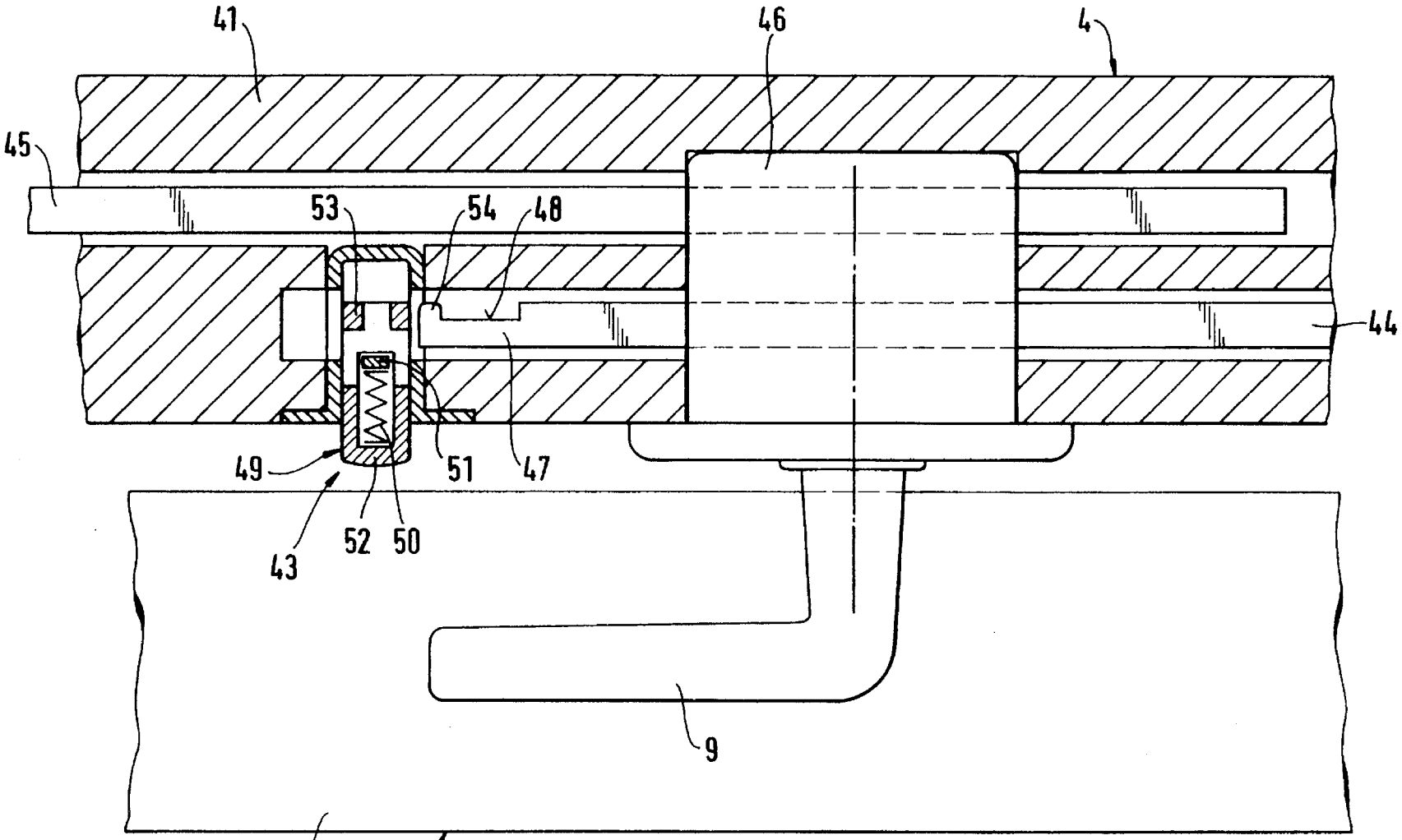

FIG. 12 shows the area of the frame lower cross-pieces 41 and 42 corresponding to FIG. 10 in the case of opening the window sash 4. By means of this opening movement, the blocking element 49 again moves downwardly by the biasing action—the spring 50, and the notch 553 lies immediately in front of the hook 54. This makes it possible to adjust the handle 9 in the direction of the arrow, and the connecting rods 44 and 45 also are movable in the direction of the arrow. This adjustment corresponds to bringing the handle 9 from the tilting position (FIG. 121) into the locking position (FIG. 13). However, the handle 9 cannot be moved into the swinging position (FIG. 9), since such an adjustment is blocked so that the hook 54 pushes the notch 53 against the catch 43.

Figure 14:
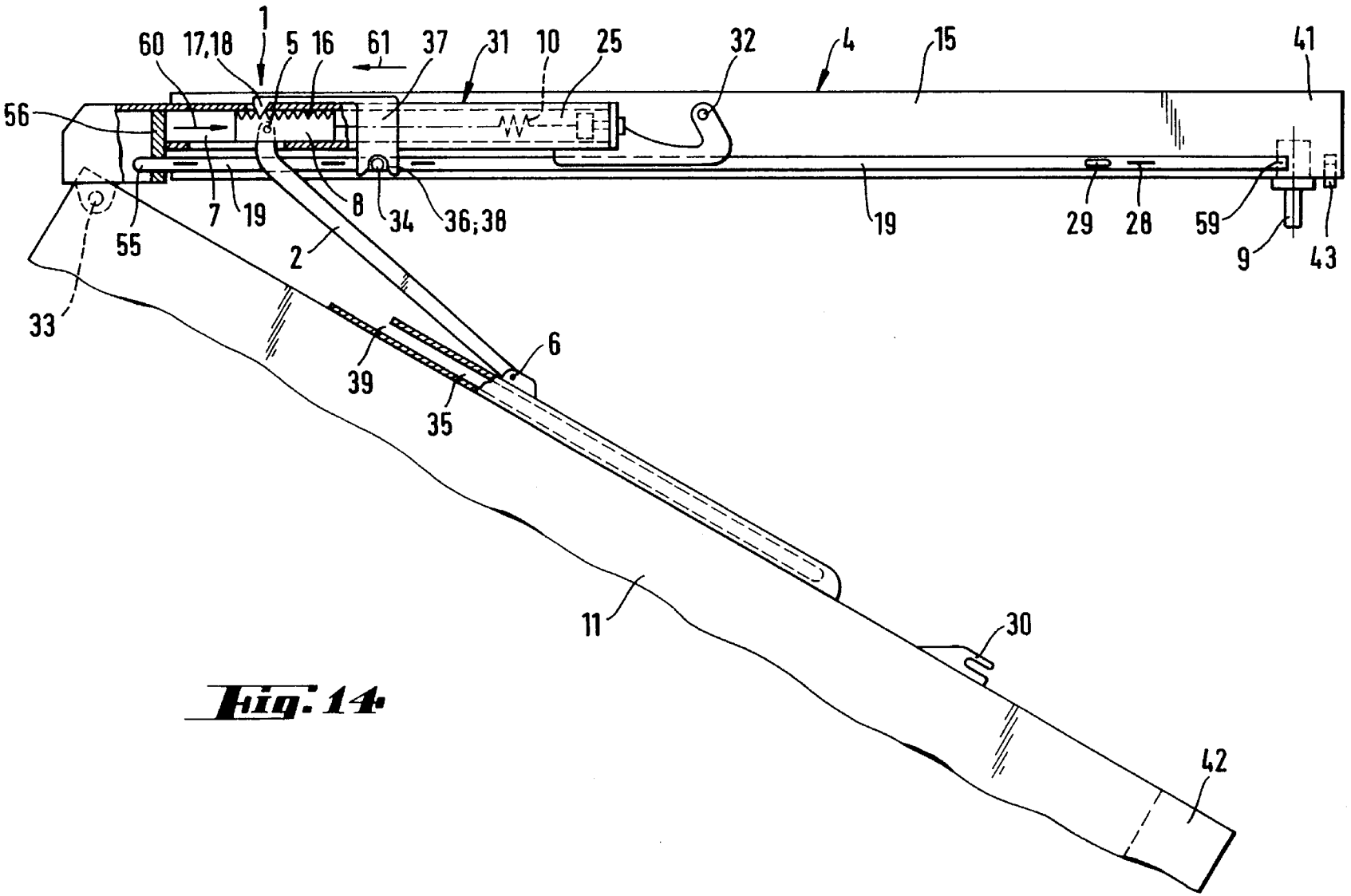

FIG. 13 shows the above-mentioned adjustment of the handle 9 into its closing position with the window sash 4 opened. This adjustment of the handle 9 leads to the actuation of the locking devices 1, which is illustrated in FIG. 14. In the case of opening the window sash 4 first, the slide 8 is shifted in the direction the holding elements 17 (arrow 60). Now, if the handle 9 is brought into its closing position with the window sash (4) open, the pivot pins 34 are moved by the connecting rods 19. In this case, the transfer elements 37 and the holding elements 17 are moved in the direction of the slides 8, as the arrow 61 shows. The holding elements 17 enter the recesses 22 (FIG. 3) and the teeth 18 of the holding elements 17 engage in the toothed racks 16 of the slide 8. The window sash 4 is locked in this way This locking action can be released by returning the handle 9 to its tilting position in which the holding elements 17 disengage from the recesses 22 and thus from the toothed racks 16 of the slides 8.

Figure 15:
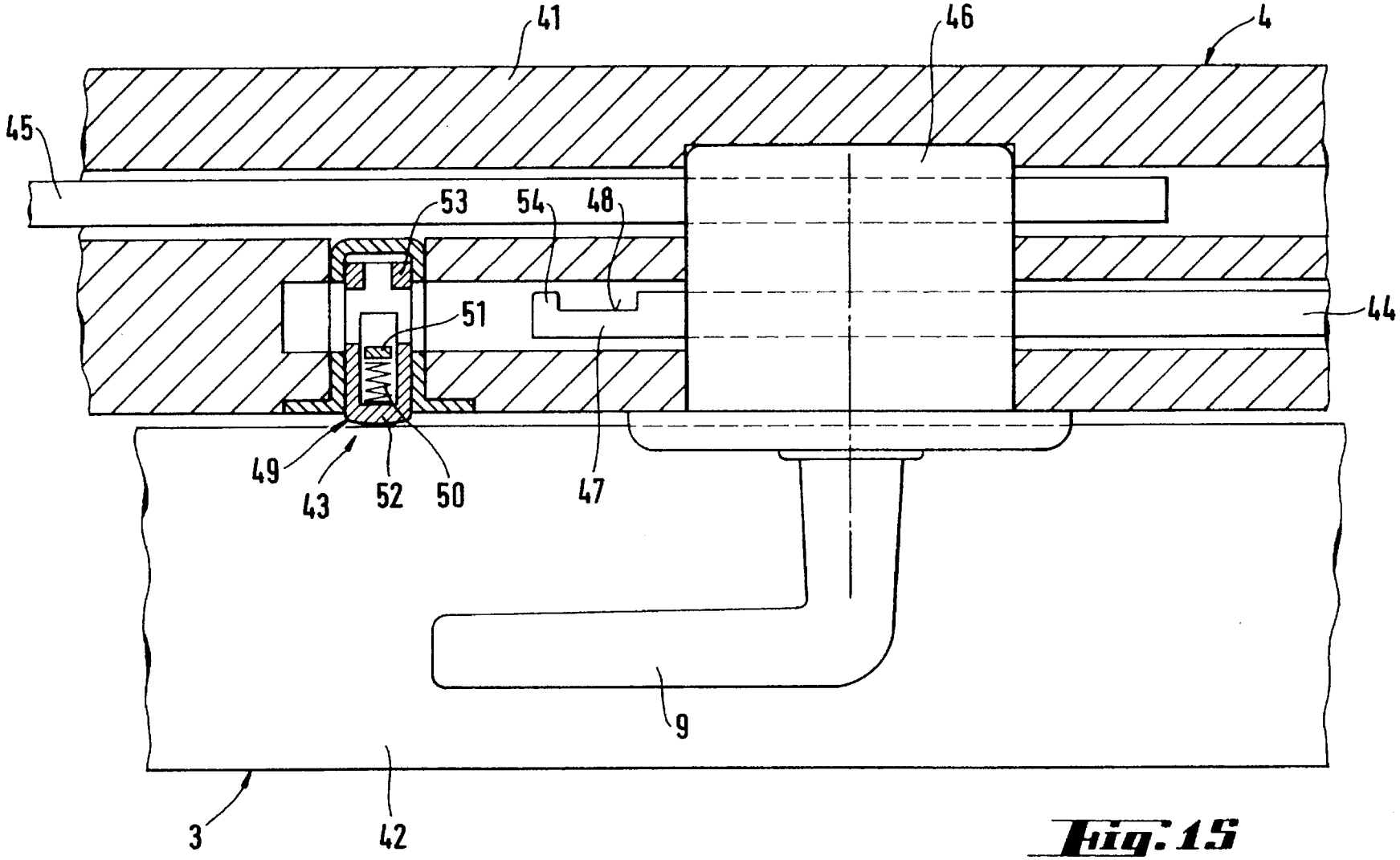
Figure 16:
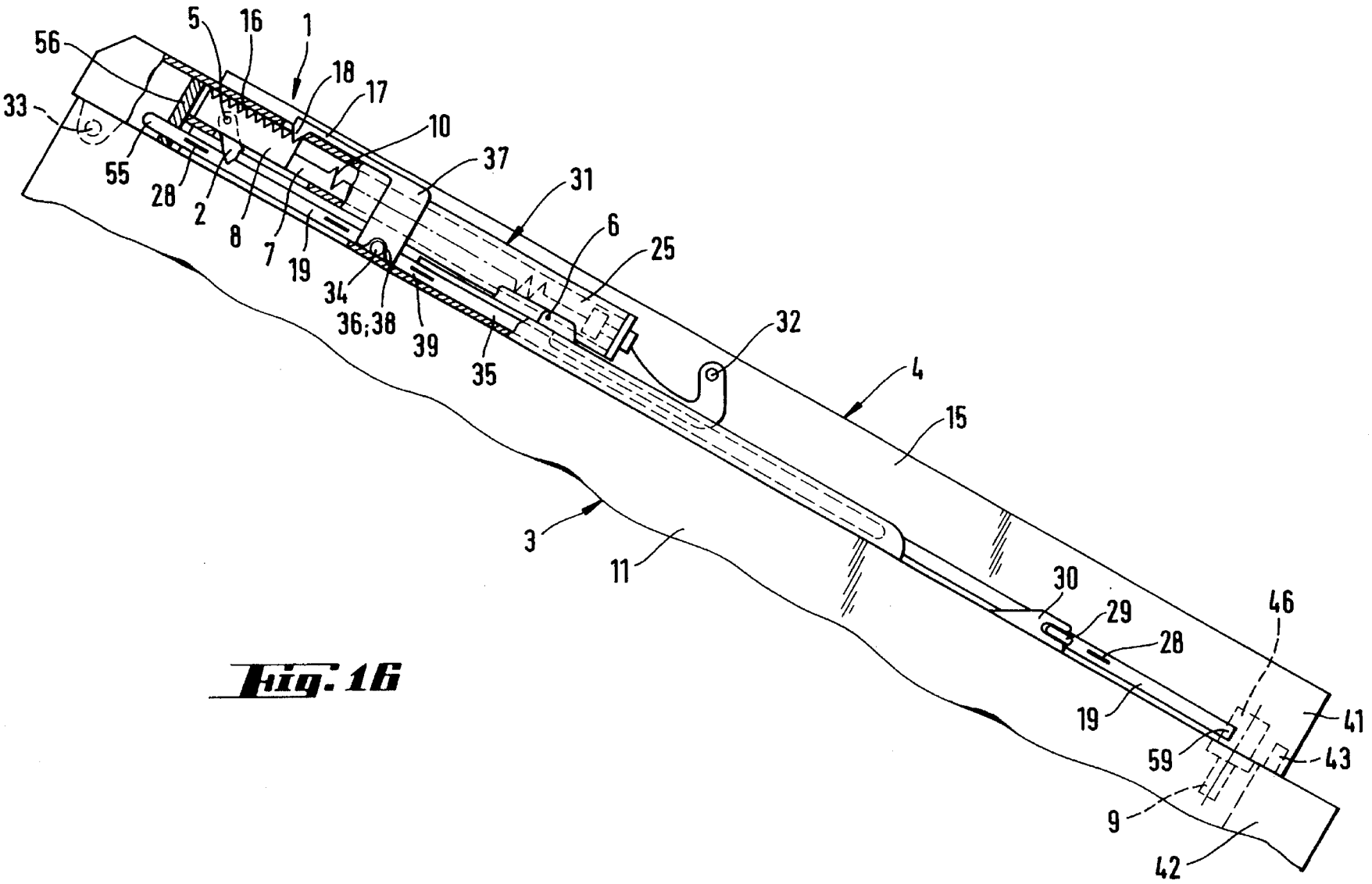

FIGS. 15 and 16 show the closed window sash and the closing tongues 29 engaging with the closing elements 30. Whether the holding elements 17 engage with the toothed racks 16 in this position or not plays no role, and this can be left to the respective design.

A locking device 1 was chosen in accordance with the embodiment of FIG. 3 for representing and explaining the invention by the illustrations of FIGS. 7 to 16. Of course these configurations also are possible with other embodiments of the locking device 1, for example with the locking device 1, as it was shown in FIGS. 2 and 2*a* or in FIG. 2*b*. As compared with the embodiment in FIG. 3, these embodiments have the advantage that a loosening of the slides 8 as a result of the action of too strong a force does not lead to a backwards motion of the window, since these slides continue to move in the guides as a result of the action of such a force.

The representations in the figures serve only as examples, other embodiments and, in particular, other combinations of the individual elements are possible.

I claim:

1. A roof window comprising a window casing (3) providing an opening and having side frame members (11); a window sash (4) extending over said opening having a frame with side members (15) and upper and lower cross members; a locking device (1) on a side member of said frame of said sash for locking said sash (4) in open positions relative to said casing (3); a device for opening said sash including at least one spring arm (2) supporting said window sash (4) on said casing (3) in the open position thereof; pivot bearings (5, 6) operatively connecting said spring arm (2) to said casing (3) and to said window sash (4), one of said pivot bearings (6) being disposed on a spring-operated slide (8) movable in a guide (7), said slide 7 being lockable by said locking device (1); and a handle (9) on said lower cross member of said sash for operating said locking device (1) said handle (9) being operatively connected to said locking device (1) by corner guides (59) and connecting rods (19, 44, 45) on said frame of said sash (4).

2. The roof window in accordance with claim 1 wherein said locking device exerts a clamping action on said slide and the clamping force of said locking device (1) is limited so that said window sash (4) will be released before forces acting on said window sash (4) would lead to damage.

3. The roof window in accordance with claim 1 wherein said locking device (1) is a cam (12).

4. The roof window in accordance with claim 1 wherein said locking device (1) is a wedge (13) which is movable relative to said slide (8) to clamp said slide 8 in said guide (7).

5. The roof window in accordance with claim 4 wherein an insert (14) is disposed between said slide (8) and said wedge (13).

6. The roof window in accordance with claim 5 wherein said insert (14) extends beyond both ends of said guide (7), is fastened on one end, and is locked on the other end by said wedge (13), and wherein said insert (14) locks said slide (8) with a predetermined force by means of longitudinal displacement of said wedge (13).

7. The roof window in accordance with claim 5 wherein said guide (7) has a plastic layer (26) at least on one side thereof.

8. The roof window in accordance with claim 4 wherein said wedge (13) can be moved longitudinally on an inclined plane (63), said wedge (13) having a length which is at least equal to the length of said guide (7), said wedge (13) having a surface with an angle of inclination which is opposite in direction but equal to said angle of inclination of said inclined plane (63), so that the surface of said wedge serving as a clamping surface is vertically adjustable by longitudinal displacement of said wedge (13).

9. The roof window in accordance with claim 1 wherein said slide (8) includes a toothed rack portion (16) and there is included a holding element (17) with at least one tooth (18) which is releasably engageable with said rack portion (16).

10. The roof window in accordance with claim 9 wherein said holding element (17) is disposed on said connecting rod (19), and wherein said guide is disposed in a tubular member (25) with an opening (22) in which said holding element (17) can enter and from which it can emerge by actuation of said connecting rod (19).

11. The roof window in accordance with claim 10 wherein said holding element (17) is biased in the direction of engagement about a fastener (20) which guides said connecting rod (19) during longitudinal movement and wherein said opening (22) has a chamfered surface (24) which cooperates with an inclined surface (23) on said holding element (17) to cam said holding element (12) outwardly of said opening (22).

12. The roof window in accordance with claim 1 wherein said handle (9) is also operatively connected to said device for the opening of said window sash (4) to effect opening and closing thereof.

13. The roof window in accordance with claim 12 wherein said handle is movable between opening and closing positions, and wherein at least one locking device (1) locks said window sash (4) when said window sash (4) is pivoted into an open position by moving said handle (9) into said closing position thereof, said sash (4) being supported on arms (31).

14. The roof window in accordance with claim 1 in which said window sash (4) is supported on arms (31) which are movable and connected to said sash (4).

15. The roof window in accordance with claim 14 wherein said window sash (4) is pivotable with respect to said arms (31) on bearings (32) and is guided by pivot pins (34) seated in grooves (35) in said window casing (3).

16. The roof window in accordance with claim 1 wherein said casing has upper and lower ends, and wherein said spring arms (2) are mounted on arms (31) pivoted to said upper end of said casing, said window sash (4) being supported by said arms (31).

17. The roof window in accordance with claim 16 wherein said arms are pivotably connected to said sash (4), said window sash (4) being guided in grooves (35) in said casing (3), said roof window including a coupling (36) providing an operative connection between said handle (9) and said locking device (1) when said locking device (1) is moved into a position permitting pivoting of said sash.

18. The roof window in accordance with claim 1 wherein said at least one locking device (1) is in operative connection with a connecting rod (19) by a transfer element (37), said operative connection (36) comprising a U-shaped indentation (38) in said transfer element (37) in which a pin on said connecting rod (19) engages when said window sash (4) is connected with said arms (31), said pin exiting said indentation (30) when said sash (4) is pivoted.

19. The roof window in accordance with claim 18 wherein a pivot pin (34) on said sash (4) guided in a groove (35) in said window casing engages in said U-shaped indentation (38), said pivot pin (34) being adjustable by said handle (9) between positions in which, when said window sash (4) is closed and when it is in a pivoted position, it is located along an arc (62) outwardly of the upper end (39) of said groove (35) and, when in the pivoting position, it is seated in said groove (35).

20. The roof window in accordance with claim 18 wherein there is included a catch (43) which acts on said handle (9) by means of which said handle (9) is blocked when said window sash (4) is pivoting.

21. A roof window comprising a window casing (3) providing an opening and having side frame members (11); a window sash (4) extending over said opening; a locking device (1) for locking said sash (4) in open positions relative to said casing (3); a device for opening said sash including at least one spring arm (2) supporting said window sash (4) on said casing (3) in the open position thereof; pivot bearings (5, 6) operatively connecting said spring arm (2) to said casing (3) and to said window sash (4), one of said pivot bearings (6) being disposed on a spring-operated slide (8) movable in a guide (7), said slide (8) being lockable by said locking device (1); and a handle (9) for operating said locking device (1), said locking device including a wedge (13) which is movable relative to said slide (8) to clamp said slide (8) in said guide (7).

22. The roof window in accordance with claim 21 wherein said guide (7) and said slide (8) are located in at least one of the side frame members (11) of said window casing (3).

23. The roof window in accordance with claim 21 wherein said guide (7) and said slide (8) are located on at least one of the side frame members (15) of said window sash (4).

24. The roof window in accordance with claim 21 wherein said guides (7) and slides (8) are located on a pair of arms (31) which support said window sash (4) when it is in an open position.

25. A roof window comprising a window casing (3) providing an opening and having side frame members (11); a window sash (4) extending over said opening; a locking device (1) for locking said sash (4) in open positions relative to said casing (3); a device for opening said sash including at least one spring arm (2) supporting said window sash (4) on said casing (3) in the open position thereof; pivot bearings (5, 6) operatively connecting said spring arm (2) to said casing (3) and to said window sash (4), one of said pivot bearings (6) being disposed on a spring-operated slide (8) movable in a guide (7), said slide (8) being lockable by said locking device (1) and including a toothed rack portion (16); a holding element (17) with at least one tooth which is engageable with said rack portion (16), said holding element (17) being disposed on a connecting rod (19) and said guide (7) being disposed in a tubular member (25) with an opening into which said holding element (17) can enter and from which it can emerge upon actuation of said connecting rod (19); and a handle (9, 9') for operating said locking device (1).

26. A roof window comprising a window casing (3) providing an opening and having side frame members (11) and upper and lower ends; a window sash (4) extending over said opening; a locking device (1) for locking said sash (4) in open positions relative to said casing (3); a device for opening said sash including at least one spring arm (2) supporting said window sash (4) on said casing (3) in the open position thereof, said spring arm (2) being mounted on arms (31) pivoted to said upper end of said casing (3), said window sash (4) being supported by said arms (31) and said arms (31) being pivotably connected to said sash (4), said window sash (4) being guided in grooves (35) in said casing (3) during swinging movement thereof relative to said casing; pivot bearings (5, 6) operatively connecting said spring arm (2) to said casing (3) and to said window sash (4), one of said pivot bearings (6) being disposed on a spring-operated slide (8) movable in a guide (7), said slide (8) being lockable by said locking device (1); a handle (9, 9') for operating said locking device (1); a coupling (36) providing an operative connection between said handle (9) and said locking device (1) when said locking device (1) is moved into a position permitting pivoting of said sash.

* * * * *